US009339149B1

(12) United States Patent
Leonard-Gardiner

(10) Patent No.: US 9,339,149 B1
(45) Date of Patent: May 17, 2016

(54) FOOD AND KITCHEN PREPARATION ASSEMBLY

(71) Applicant: Nancy Leonard-Gardiner, East Hartford, CT (US)

(72) Inventor: Nancy Leonard-Gardiner, East Hartford, CT (US)

( * ) Notice: Subject to any disclaimer, the term of this patent is extended or adjusted under 35 U.S.C. 154(b) by 213 days.

(21) Appl. No.: 14/264,555

(22) Filed: Apr. 29, 2014

(51) Int. Cl.
*A47K 1/06* (2006.01)

(52) U.S. Cl.
CPC ..... *A47K 1/06* (2013.01)

(58) Field of Classification Search
CPC ..... A22C 17/0013; A22C 17/0093; A47B 33/00; A47J 47/00; A47J 47/005; A47J 47/20; A47K 1/06
USPC ..... 119/169; 206/204; 220/204, 495.03, 220/574.3; 269/289 R, 302.1, 329; 4/452, 4/580–583, 655, 657, 658, 661; 426/129, 426/513, 518
See application file for complete search history.

(56) References Cited

U.S. PATENT DOCUMENTS 2,421,808 A 6/1947 Robertson
2,806,227 A 9/1957 Arbetter
2,817,851 A * 12/1957 Barnwell ..... A47K 1/06 4/655
5,660,868 A * 8/1997 Yeager ..... B65D 81/264 206/204
5,815,856 A 10/1998 Dore
5,991,942 A * 11/1999 Neal ..... A47K 1/06 4/654
6,095,325 A * 8/2000 Simhaee ..... B65D 81/264 206/204
6,223,362 B1 * 5/2001 Liang ..... A47K 1/06 4/245.4
6,338,171 B1 1/2002 Dandridge
7,685,654 B1 3/2010 Jones
7,951,292 B1 5/2011 De La Torre
2005/0188458 A1 9/2005 Dickstein
2007/0180610 A1 * 8/2007 Mohr ..... E03C 1/186 4/655
2008/0201840 A1 8/2008 Hill
2010/0187741 A1 * 7/2010 Fischer ..... A47J 47/005 269/289 R
2011/0219536 A1 * 9/2011 McGriff ..... A47K 1/06 4/655

* cited by examiner

*Primary Examiner* — Paul R Durand
*Assistant Examiner* — Nicholas Ros
(74) *Attorney, Agent, or Firm* — Kyle A. Fletcher, Esq.

(57) ABSTRACT

The food preparation assembly for preventing cross contamination includes a liner that is positionable in a sink. The liner may contain a food item. The liner is discarded after the food item is removed from the liner or the food item and liner are discarded together. A lip is coupled to the liner. A pad is coupled to the liner. The pad may absorb a fluid. A drain aperture extends through the liner. The drain liner is aligned with a drain in the sink.

18 Claims, 4 Drawing Sheets

FOOD AND KITCHEN PREPARATION ASSEMBLY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of sanitary food bags, more specifically, a bag configured for use with a kitchen sink in order to prepare food.

SUMMARY OF THE INVENTION

An embodiment of the disclosure meets the needs presented above by generally comprising a liner that is positionable in a sink. The liner may contain a food item. The liner is discarded after the food item is removed from the liner or the food item and liner are discarded together. A lip is coupled to the liner. A pad is coupled to the liner. The pad may absorb a fluid. A drain aperture extends through the liner. The drain liner is aligned with a drain in the sink. Both the pad and the liner are lined with an outer liner that interfaces with the drain and the sink.

An object of the invention is for a preparation assembly that is configured to be placed into a sink in order to absorb fluids that come out as a result of preparation of certain foods.

These together with additional objects, features and advantages of the food and kitchen preparation assembly will be readily apparent to those of ordinary skill in the art upon reading the following detailed description of presently preferred, but nonetheless illustrative, embodiments of the food and kitchen preparation assembly when taken in conjunction with the accompanying drawings.

In this respect, before explaining the current embodiments of the food and kitchen preparation assembly in detail, it is to be understood that the food and kitchen preparation assembly is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of food and kitchen preparation assembly.

It is therefore important that the claims be regarded as including such equivalent construction insofar as they do not depart from the spirit and scope of food and kitchen preparation assembly. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

Figure 1:
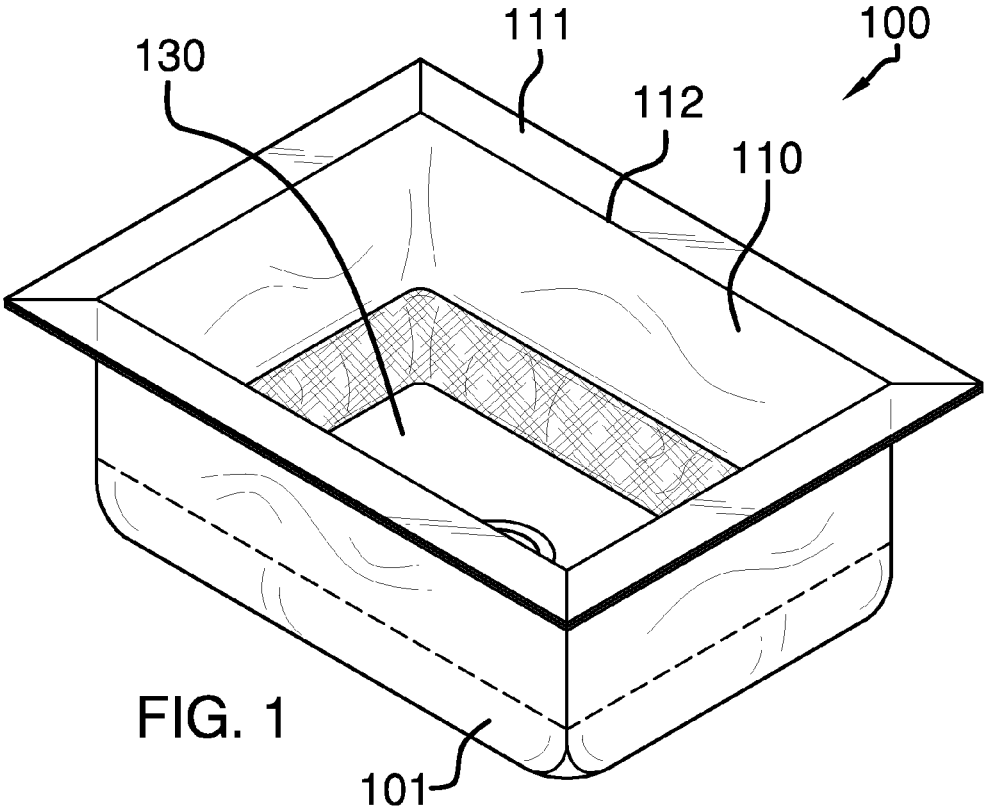
FIG. 1 is a perspective view of a food preparation assembly according to an embodiment of the disclosure.
Figure 2:
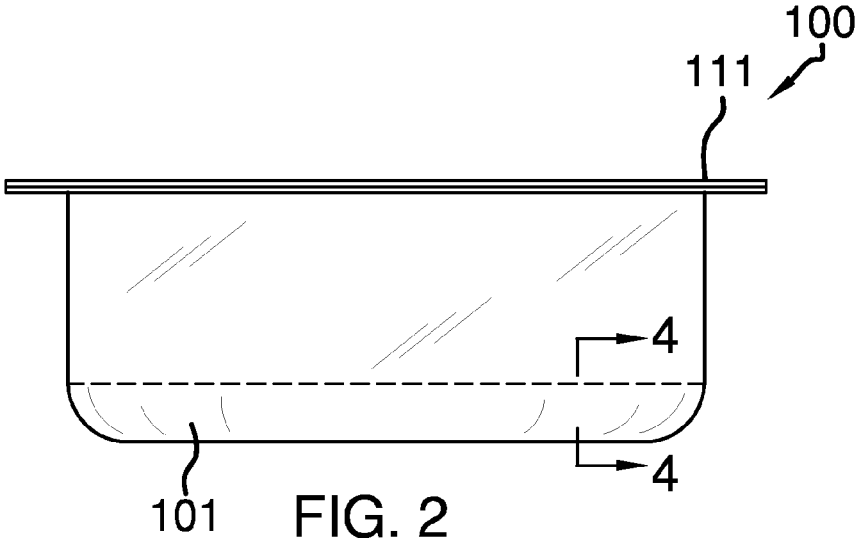
FIG. 2 is a right side view of an embodiment of the disclosure.
Figure 3:
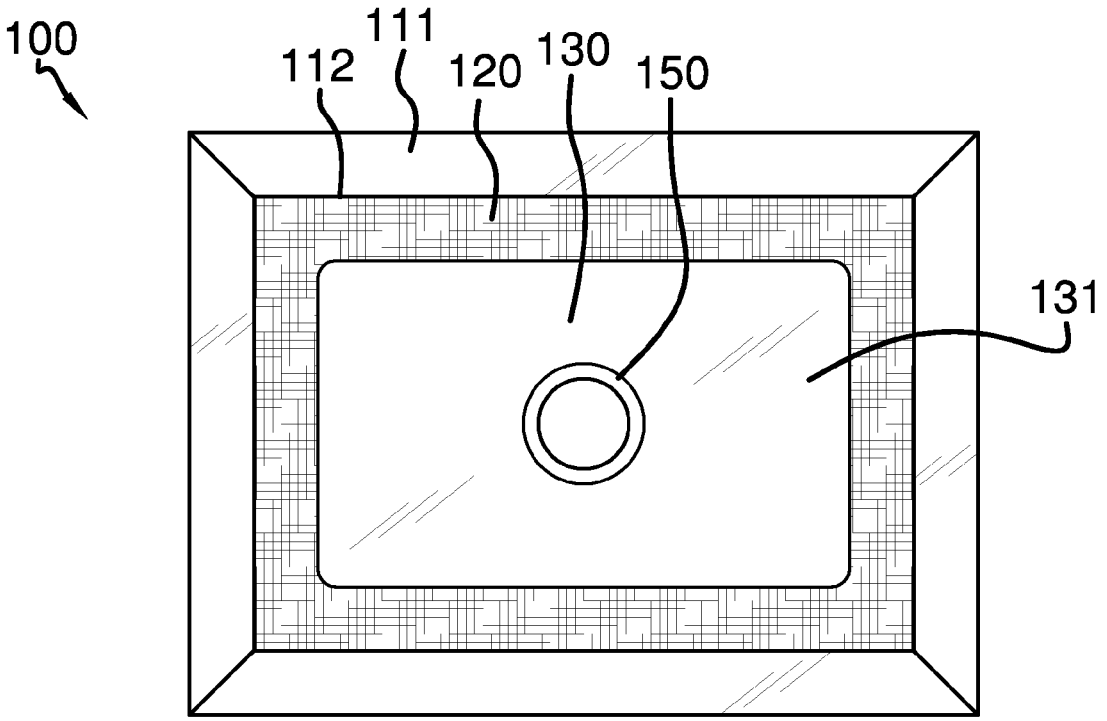
FIG. 3 is a top view of an embodiment of the disclosure.
Figure 4:
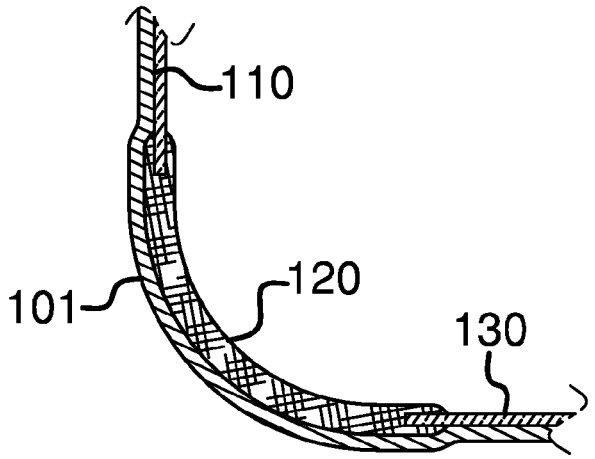
FIG. 4 is a cross sectional view taken along line 4-4 of FIG. 2 of an embodiment of the disclosure.
Figure 5:
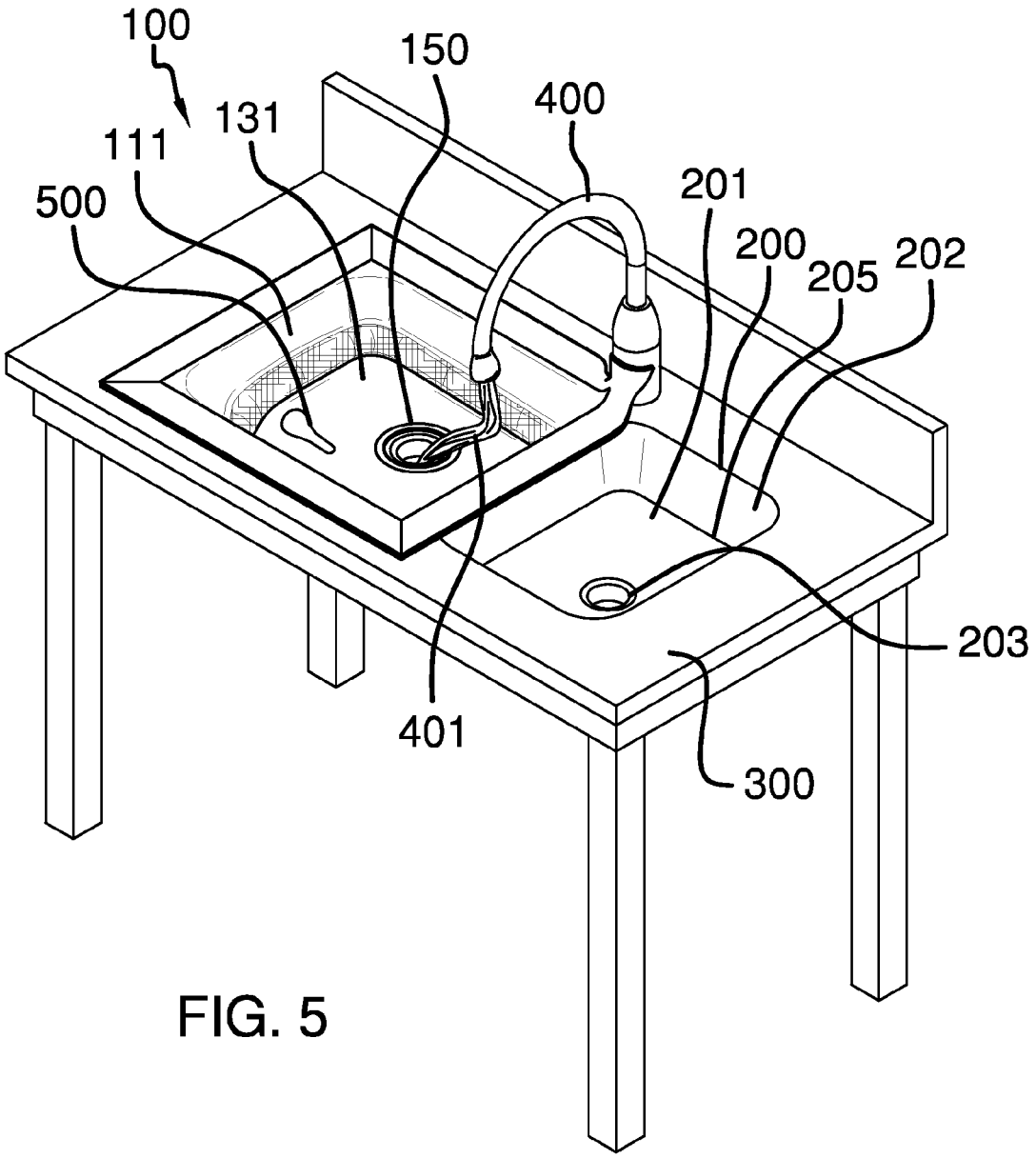
FIG. 5 is an in-use view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 5, the food preparation assembly 100 (hereinafter invention) generally comprises an outer liner 101. The outer liner 101 is configured to be positioned against a sink 200. That being said, the sink 200 shall be further defined with a bottom sink surface 201, sink side surfaces 202, and a sink drain 203. The outer liner 101 is tailored to fit against the bottom sink surface 201, and the sink side surfaces 202.

The food preparation assembly includes an inner liner 110 that is coupled with a pad member 120. A bottom inner liner 130 is affixed to the pad member 120. The inner liner 110, the pad member 120, and the bottom inner liner 130 are all affixed to the outer liner 101. Moreover, the inner liner 110, the pad member 120, and the bottom inner liner 130 are all affixed to the outer liner 101 internally such that the inner liner 110, the pad member 120, and the bottom inner liner 130 do not come into contact with the sink 200.

The pad member 120 is positioned between the inner liner 110 and the bottom inner liner 130. The inner liner 110 is configured to be parallel with the sink side surfaces 202 of the sink 200; whereas the bottom inner liner 130 is configured to be parallel with the bottom sink surface 201. The pad member 120 is configured to be adjacent to a sink surface bend 205 that exists where the sink side surfaces 202 meet the bottom sink surface 201.

It shall be noted that the inner liner 110 includes a top flange member 111 that is perpendicularly-oriented with respect to the inner liner 110. The top flange member 111 extends outwardly from a top crease 112. Moreover, the top flange member 111 is also affixed to the outer liner 101. The top flange member 111 and the portion of the outer liner 101 affixed thereto are configured to be placed onto a countertop surface 300.

The bottom inner liner 130 and portion of the outer liner 101 adjacent thereto feature a drain aperture 150. The drain aperture 150 of the invention 100 is configured to be aligned above the sink drain 203 such that when a faucet 400 is in use, excess water 401 is able to pass through the invention 100.

The pad member 120 is made of a highly absorbent material that is able to quickly absorb fluid that is produced when handling certain food items 500, such as chicken. It shall be noted that the prime use of the invention 100 is to contain and prevent cross-contamination of uncooked foods. The pad member 120 is impregnated with an anti-microbial solution. The bottom inner liner 130 and the inner liner 110 are made of an impermeable material that is impregnated with an anti-microbial solution. The outer liner 101 is made of an impermeable material.

Figure 7:
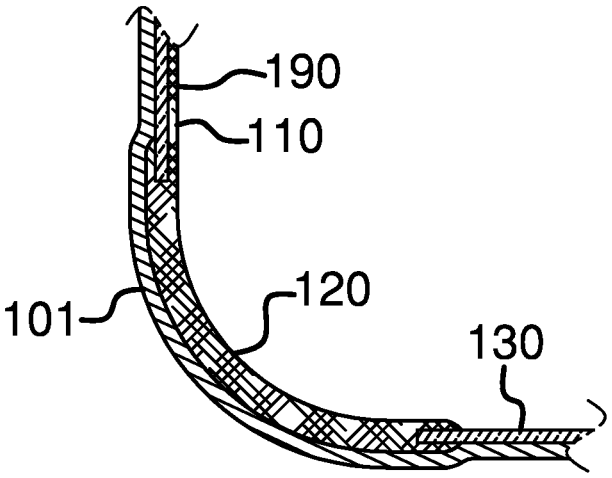
FIG. 7 is a cross sectional view taken line 4-4 of FIG. 2 of an alternative embodiment of the disclosure.
Figure 6:
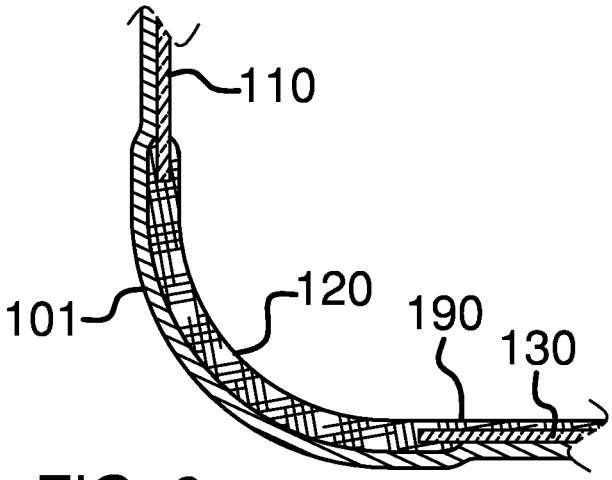
FIG. 6 is a cross sectional view taken line 4-4 of FIG. 2 of an alternative embodiment of the disclosure.

Optionally, a film 190 is coupled to a top side 131 of the bottom inner liner 130 (see FIG. 6). Further, the film 190 completely covers the top side 131 of the bottom inner liner 130 of the invention 100. Optionally, the film 190 may be provided on an inner side surface 115 of the inner liner 110 (see FIG. 7). Moreover, the film 190 may be comprised of an anti-bacterial chemical of any conventional design. Moreover, the film 190 kills bacteria in the fluid from the uncooked food items.

Moreover, the pad member 120 may be comprised of a deformable and fluid absorbent material such as cotton, or other fibrous material, or other similar material. The outer liner 101, the pad member 120, the inner liner 110, and the bottom inner liner 130 are made of a deformable material such that the invention 100 as a whole is able to bend and accommodate different shapes and contours of the sink 200.

In use, the invention 100 is positioned in the sink 200. Continuing, the food item 500 is positioned in the inner bottom liner 130. The food item 500 is washed or otherwise prepared for cooking while the food item 500 is in the inner bottom liner 130. Lastly, the entire invention 100 is discarded after the food item 500 is prepared so cross contamination does not occur between multiple food items.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A food preparation assembly for preventing cross contamination, said assembly comprising:

an outer liner having an inner liner, a pad member, and a bottom inner liner provided therein;

wherein said outer liner is configured to be positioned in a sink;

wherein a food item is placed on the bottom inner liner while said food item is being prepared;

said pad member being configured to absorb fluids that come out of the preparation of the food item;

wherein the assembly is discarded after the food item is prepared so cross contamination does not occur between multiple food items;

wherein the outer liner is configured to interface against a sink; wherein the outer liner is configured to rest against a bottom sink surface, and a sink side surfaces of the sink;

wherein the inner liner is coupled with the pad member; wherein the bottom inner liner is affixed to the pad member; wherein the inner liner, the pad member, and the bottom inner liner are all affixed to the outer liner.

2. The assembly according to claim 1 wherein the inner liner, the pad member, and the bottom inner liner are all affixed to the outer liner internally such that the inner liner, the pad member, and the bottom inner liner do not come into contact with the sink.

3. The assembly according to claim 2 wherein the pad member is positioned between the inner liner and the bottom inner liner.

4. The assembly according to claim 3 wherein the inner liner is configured to be parallel with the sink side surfaces of the sink.

5. The assembly according to claim 3 wherein the bottom inner liner is configured to be parallel with the bottom sink surface.

6. The assembly according to claim 3 wherein the pad member is configured to be adjacent to a sink surface bend that exists where the sink side surfaces meet the bottom sink surface.

7. The assembly according to claim 3 wherein the inner liner includes a top flange member that is perpendicularly-oriented with respect to the inner liner;

wherein the top flange member extends outwardly from a top crease.

8. The assembly according to claim 7 wherein the top flange member is affixed to the outer liner; wherein the top flange member and the portion of the outer liner affixed thereto are configured to be placed onto a countertop surface.

9. The assembly according to claim 8 wherein the bottom inner liner and portion of the outer liner adjacent thereto feature a drain aperture; wherein the drain aperture is configured to be aligned above a sink drain such that when a faucet is in use, excess water is able to pass through the drain aperture.

10. The assembly according to claim 3 wherein the pad member is made of a highly absorbent material that is able to quickly absorb fluid that is produced when handling the food items; wherein the pad member is comprised of a deformable and fluid absorbent material comprising cotton, or other fibrous material, or other similar material; wherein the outer liner, the pad member, the inner liner, and the bottom inner liner are made of a deformable material such that the assembly as a whole is able to bend and accommodate different shapes and contours of the sink.

11. The assembly according to claim 3 wherein the pad member is impregnated with an anti-microbial solution.

12. The assembly according to claim 3 wherein the outer liner is made of an impermeable material.

13. The assembly according to claim 3 wherein a film is coupled to a top side of the bottom inner liner; wherein the film completely covers the top side of the bottom inner liner; wherein the film is comprised of an anti-bacterial chemical of any conventional design; wherein the film kills bacteria in the fluid from the uncooked food items.

14. The assembly according to claim 3 wherein a film is provided on an inner side surface of the inner liner; wherein the film completely covers the top side of the bottom inner liner; wherein the film is comprised of an anti-bacterial chemical of any conventional design; wherein the film kills bacteria in the fluid from the uncooked food items.

15. A food preparation assembly for preventing cross contamination, said assembly comprising:

an outer liner having an inner liner, a pad member, and a bottom inner liner provided therein;

wherein said outer liner is configured to be positioned in a sink;

wherein a food item is placed on the bottom inner liner while said food item is being prepared;

said pad member being configured to absorb fluids that come out of the preparation of the food item;

wherein the assembly is discarded after the food item is prepared so cross contamination does not occur between multiple food items;

wherein the outer liner is configured to interface against a sink; wherein the outer liner is configured to rest against a bottom sink surface, and a sink side surfaces of the sink;

wherein the inner liner is coupled with the pad member; wherein the bottom inner liner is affixed to the pad member; wherein the inner liner, the pad member, and the bottom inner liner are all affixed to the outer liner;

wherein the inner liner, the pad member, and the bottom inner liner are all affixed to the outer liner internally such that the inner liner, the pad member, and the bottom inner liner do not come into contact with the sink;

wherein the pad member is positioned between the inner liner and the bottom inner liner;

wherein the inner liner is configured to be parallel with the sink side surfaces of the sink.

16. The assembly according to claim 15 wherein the bottom inner liner is configured to be parallel with the bottom sink surface; wherein the pad member is configured to be adjacent to a sink surface bend that exists where the sink side surfaces meet the bottom sink surface.

17. The assembly according to claim 16 wherein the inner liner includes a top flange member that is perpendicularly-oriented with respect to the inner liner; wherein the top flange member extends outwardly from a top crease; wherein the top flange member is affixed to the outer liner; wherein the top flange member and the portion of the outer liner affixed thereto are configured to be placed onto a countertop surface; wherein the bottom inner liner and portion of the outer liner adjacent thereto feature a drain aperture; wherein the drain aperture is configured to be aligned above a sink drain such that when a faucet is in use, excess water is able to pass through the drain aperture.

18. The assembly according to claim 17 wherein the pad member is made of a highly absorbent material that is able to quickly absorb fluid that is produced when handling the food items; wherein the pad member is comprised of a deformable and fluid absorbent material comprising cotton, or other fibrous material, or other similar material; wherein the outer liner, the pad member, the inner liner, and the bottom inner liner are made of a deformable material such that the assembly as a whole is able to bend and accommodate different shapes and contours of the sink; wherein the pad member is impregnated with an anti-microbial solution; wherein the outer liner is made of an impermeable material; wherein a film is coupled to a top side of the bottom inner liner; wherein the film completely covers the top side of the bottom inner liner; wherein the film is comprised of an anti-bacterial chemical of any conventional design; wherein the film kills bacteria in the fluid from the uncooked food items; wherein a film is provided on an inner side surface of the inner liner; wherein the film completely covers the top side of the bottom inner liner; wherein the film is comprised of an anti-bacterial chemical of any conventional design; wherein the film kills bacteria in the fluid from the uncooked food items.

* * * * *